US007891914B2

(12) United States Patent
Smallwood et al.

(10) Patent No.: US 7,891,914 B2
(45) Date of Patent: Feb. 22, 2011

(54) GEOTEXTILE TUBE

(75) Inventors: Joe Lamon Smallwood, Statesboro, GA (US); William Alton Smallwood, Statesboro, GA (US)

(73) Assignee: Flint Industries, Inc., Metter, GA (US)

( * ) Notice: Subject to any disclaimer, the term of this patent is extended or adjusted under 35 U.S.C. 154(b) by 128 days.

(21) Appl. No.: 12/286,484

(22) Filed: Sep. 30, 2008

(65) Prior Publication Data

US 2009/0129866 A1 May 21, 2009

Related U.S. Application Data

(60) Provisional application No. 61/003,214, filed on Nov. 15, 2007.

(51) Int. Cl.
*B65D 30/00* (2006.01)

(52) U.S. Cl. ..... 405/302.6; 405/15; 405/16; 405/18; 383/66; 383/107; 383/117

(58) Field of Classification Search ..... 405/15, 405/16, 17, 18, 107, 111, 114, 262, 284, 405/286, 287, 302.4, 302.6, 302.7; 383/66, 383/105, 107, 117, 119
See application file for complete search history.

(56) References Cited

U.S. PATENT DOCUMENTS 3,340,919 A * 9/1967 Holbrook ..... 383/117
3,886,751 A * 6/1975 Porraz Jimenez Labora ..... 405/107
3,957,098 A * 5/1976 Hepworth et al. ..... 383/45
4,420,275 A * 12/1983 Ruser ..... 405/217
4,629,651 A * 12/1986 Davis ..... 405/16
5,232,429 A * 8/1993 Cizek et al. ..... 156/195
5,584,599 A * 12/1996 Knittel ..... 405/15
5,902,070 A 5/1999 Bradley
6,056,438 A * 5/2000 Bradley ..... 383/66
6,186,701 B1 2/2001 Kempers
6,623,214 B1 9/2003 Hauske
7,097,390 B1 * 8/2006 Moss ..... 405/284
7,112,283 B2 9/2006 Stephens
7,357,598 B1 * 4/2008 Bradley ..... 405/15
2003/0035689 A1 * 2/2003 Metz ..... 405/19
2005/0163568 A1 * 7/2005 Sanguinetti ..... 405/15
2006/0102565 A1 5/2006 Alford
2008/0080936 A1 * 4/2008 Quinley et al. ..... 405/302.7
2009/0249676 A1 * 10/2009 Davis et al. ..... 222/630

* cited by examiner

*Primary Examiner*—Frederick L Lagman
(74) *Attorney, Agent, or Firm*—J. Bennett Mullinax LLC

(57) ABSTRACT

A geotextile tube is provided. The geotextile tube includes a first sheet and second sheet that both have first portions with a first weave pattern and second portions with a second weave pattern. The first portion of the first sheet covers a larger surface area than the second portion of the first sheet. Likewise, the first portion of the second sheet covers a larger surface area than the second portion of the second sheet. A seam contacts and attaches the second portion of the first sheet to the second portion of the second sheet.

19 Claims, 5 Drawing Sheets

GEOTEXTILE TUBE

RELATED APPLICATIONS

This application claims the benefit of U.S. Provisional Application Ser. No. 61/003,214 filed on Nov. 15, 2007 and which is incorporated herein by reference.

FIELD OF THE INVENTION

The present invention relates generally to geotextile tubes for use in applications such as erosion control and dewatering. More particularly, the present application involves a geotextile tube with enhanced seam placement, enhanced seam formation and/or improved fill port construction in order to improve the resulting strength and longevity thereof.

BACKGROUND

Geotextile tubes are constructed of a plurality of geotextile sheets connected to one another through the formation of seams. When used as an erosion control device, material can be dredged from a nearby body of water or transported to the site and mixed in a slurry or mechanically inserted dry. Any water present in the fill material will flow through the geotextile sheets making up the geotextile tube leaving the resultant structure with a generally cylindrical or ovoid shape. Geotextile tubes can also be filled with materials such as sludge, slurries, sediments, and emulsions. In these instances, removal of water from the aforementioned fill material is desired. Water present in these materials can again flow through the sheets of the geotextile tube to result in a more solid component remaining within the geotextile tube for easier sell, reuse or disposal.

One problem associated with geotextile tubes involves tearing of the geotextile sheet that results in leakage of the material contained therein. For example, a geotextile tube used to control beach erosion may become torn and sand or other fill material contained therein may be washed out due to wave action striking the geotextile tube. Tears in the geotextile tube can result through contact with driftwood, improperly formed seams that connect the geotextile sheets, or through forces placed onto the seams during operations such as filling of the geotextile tube. Tears may also occur as a result of forces placed onto portions of the geotextile tube such as the fill port when the geotextile tube is attempted to be moved, repositioned, or through stress applied by a filling hose at the fill port.

The seams of a geotextile tube are generally the weakest portion of the entire structure and are thus the most likely area prone to failure. Present construction of some geotextile tubes involve attaching geotextile sheets together so that longitudinal, spiral, or circumferential seams are formed along the length of the geotextile tube. The ends of the geotextile tube are then closed with one or more transverse seams. The location and arrangement of these transverse seams often subjected them to pulling or tearing forces which cause their failure.

An additional weak spot in conventional geotextile tubes can be found at the fill ports. Typically, the fill port is formed by cutting a circular hole at the top of the geotextile tube and mechanically sewing a small cylindrical tube made from a geotextile sheet thereto. The resulting seam is generally poorly formed due to its circular shape. Also, the circular hole cut into the top of the geotextile tube does not have a factory selvage about its circumference. As such, this area is subject to raveling and can pull loose when placed under stress. As such, there remains room for variation and improvement within the art.

SUMMARY

Various features and advantages of the invention will be set forth in part in the following description, or may be obvious from the description, or may be learned from practice of the invention.

One aspect of one exemplary embodiment includes a first sheet that has a first portion with a first weave pattern and a second portion with a second weave pattern. The first portion of the first sheet covers a larger surface area of the first sheet than the second portion of the first sheet. A second sheet is present and has a first portion with a first weave pattern and a second portion with a second weave pattern. The first portion of the second sheet covers a larger surface area of the second sheet than the second portion of the second sheet. A seam contacts and attaches the second portion of the first sheet to the second portion of the second sheet.

Another aspect is provided in an exemplary embodiment as immediately discussed in which the seam does not contact the first portion of the first sheet. Likewise, the seam does not contact the first portion of the second sheet.

An additional aspect is found in an exemplary embodiment as discussed previously in which the second weave pattern of the second portion of the first sheet is denser than the first weave pattern of the first portion of the first sheet. Also, the second weave pattern of the second portion of the second sheet is denser and stronger than the first weave pattern of the first portion of the second sheet. The second portions of both of the first sheet and the second sheet are at least two inches in width. The first sheet and the second sheet are made of woven geotextile fabric.

Another aspect in accordance with an additional exemplary embodiment resides in a geotextile tube that has a plurality of sheets. The sheets are attached to one another so as to form a top, bottom, first end, second end, first side, and second side of the geotextile tube. The first end and the second end are opposite one another in the longitudinal direction, and the first side and the second side are opposite one another in the transverse direction. A transverse seam is present and contacts and attaches one of the sheets that forms at least a portion of the bottom of the geotextile tube to one of the sheets that forms at least a portion of the first end of the geotextile tube. The transverse seam is located on the bottom of the geotextile tube.

Also provided in accordance with an aspect of another exemplary embodiment is a geotextile tube as immediately discussed in which the first end does not have a seam that extends in the transverse direction located thereon.

A further aspect of an additional exemplary embodiment is found in a geotextile tube as immediately discussed in which the second end does not have a seam that extends in the transverse direction located thereon.

Another aspect of one exemplary embodiment resides in a geotextile tube that has a plurality of sheets attached to one another so as to form a top, bottom, first end, second end, first side, and second side of the geotextile tube. The first end and the second end are opposite one another in the longitudinal direction, and the first side and the second side are opposite one another in the transverse direction. A fabric port tube is attached to at least one of the sheets that forms at least a portion of the top of the geotextile tube. Also, a fill port seam is present and attaches and contacts the fabric port tube and a plurality of flaps of the at least one of the sheets that forms at least a portion of the top of the geotextile tube.

Another aspect of yet another exemplary embodiment is provided in a geotextile tube as immediately mentioned in which the fabric port tube defines a circular shaped opening. The plurality of flaps are triangular in shape and are located about the entire perimeter of the circular shaped opening of the fabric port tube. The plurality of flaps contact the inner surface of the one of the sheets that forms at least a portion of the top of the geotextile tube.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
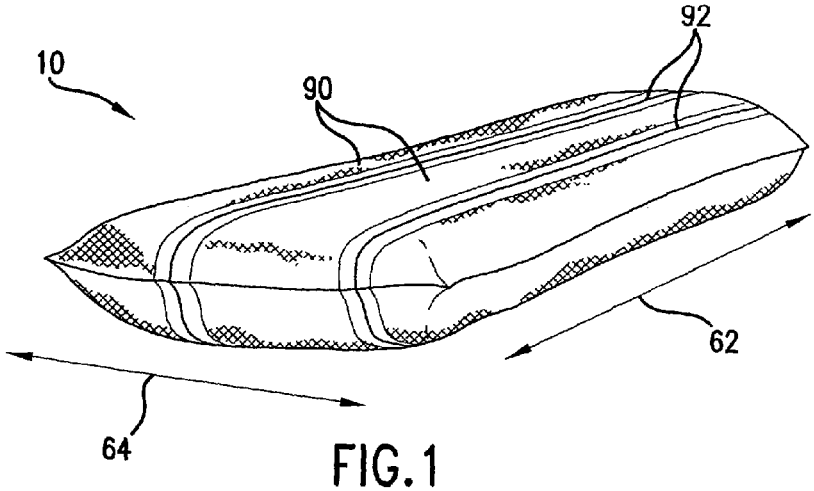
FIG. 1 is a perspective view of a geotextile tube in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a geotextile tube 10 that can be used in a number of applications. For example, the geotextile tube 10 may be used for dewatering sludge or for shoreline erosion. The geotextile tube 10 may be made of a plurality of sheets 90 that are attached through the use of one or more seams 92. One such sheet 12 can have a first portion 14 and a second portion 18 that have different weave patterns 16, 20. The second weave pattern 20 may be stronger than the first weave pattern 16. A seam 92, such as a longitudinal seam 32 of the geotextile tube 10, can be attached to the second weave pattern 20 of the second portion 18 and can also be attached to a subsequent second sheet 22. Placement of the seam 92 into enhanced or strengthened portions of the sheets 90 effects a stronger connection and reduces weak points in the geotextile tube 10. Also, the geotextile tube 10 can be arranged so that one or both of the ends 46, 48 do not have a transverse seam 58 located thereon. In this regard, the transverse seam 58 can be located on the bottom 44 of the geotextile tube 10 and may be spaced from the ends 46, 48. Elimination of transverse seams 58 on the ends 46, 48 may help to strengthen the resulting geotextile tube 10 and prevent rupture at these locations. Additionally or alternatively, the geotextile tube 10 may be provided with a fabric port tube 66 that is attached to a top 42 of the geotextile tube 10. A fill port seam 68 may be used to attach the fabric port tube 66 at this location. Aside from contacting the fabric port tube 66, the fill port seam 68 may also contact one or more flaps 72 of a top sheet 70 so as to effect a stronger attachment of the fabric port tube 66.

A geotextile tube 10 is shown in FIG. 1 in accordance with one exemplary embodiment. The geotextile tube 10 is made of a plurality of sheets 90 that are attached through the use of seams 92. Any number of sheets 90 and seams 92 may be used in accordance with various exemplary embodiments to arrive at a geotextile tube 10 of a desired size and shape. For example, from one to ten sheets 90 can be present in the geotextile tube 10 in accordance with certain exemplary embodiments. In accordance with other exemplary embodiments, up to fifty sheets 90 can be present in the geotextile tube 10. The sheets 90 can be fabricated from a variety of different geotextile fabrics. For example, the sheets 90 can be made from polypropylene, polyester or nylon in accordance with various embodiments. The sheets 90 may have a variety of weave or construction patterns and may be made from a variety of different yarns.

Figure 2:
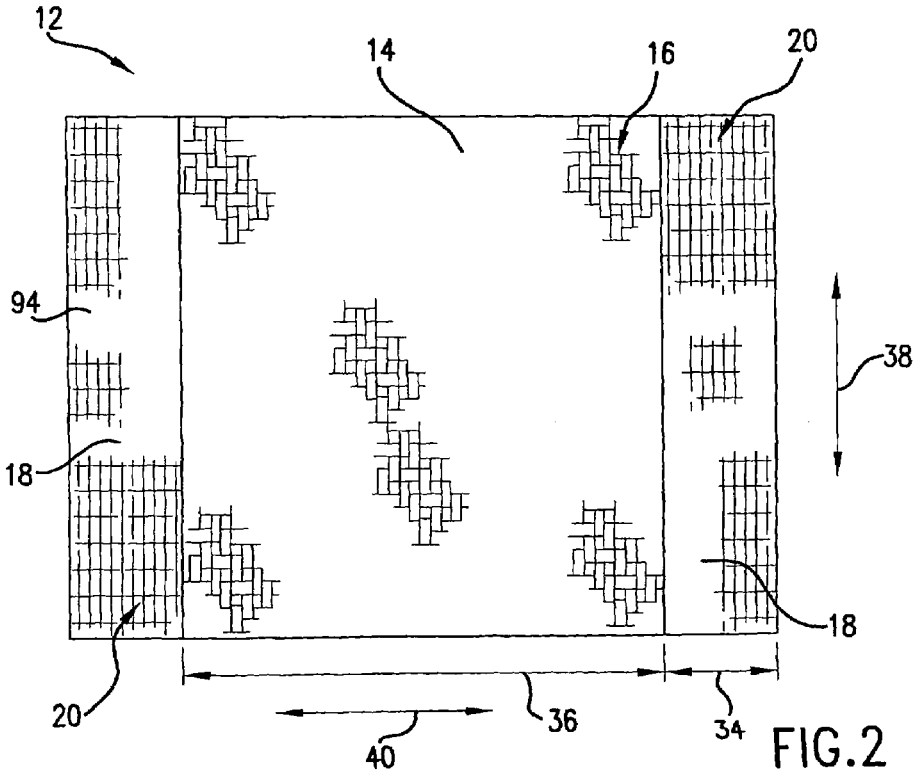
FIG. 2 is a plan view of a first sheet used in the construction of the geotextile tube of FIG. 1

FIG. 2 shows a first sheet 12 that can be present in the geotextile tube 10 in accordance with one exemplary embodiment. The first sheet 12 has a first portion 14 and a second portion 18. The first portion 14 has a first weave pattern 16, and the second portion 18 has a second weave pattern 20. The first weave pattern 16 and second weave pattern 20 are different from one another. In accordance with one exemplary embodiment, the second weave pattern 20 is denser and stronger than the first weave pattern 16. The second portion 18 may be the selvage of the first sheet 12 in accordance with one exemplary embodiment. As such, the second portion 18 may be thought of as an enhancement to the natural selvage of the first sheet 12 and thus located adjacent the natural selvage that would have been present, or the second portion 18 may be thought of as the complete selvage along one side of the first sheet 12. The second portion 18 may cover less of the surface area of the geotextile tube 10 than the first portion 14. As such, the second weave pattern 20 may be found over less surface area than the first weave pattern 16 of the first sheet 12. The first portion 14 is shown having a width 36, and the second portion 18 is shown with a width 34. Width 34 of the second portion 18 may be from four to six inches in accordance with certain exemplary embodiments. However, it is to be understood that the width 34 can be any distance in other embodiments. For example, the width 34 may be from three to five inches, from two to seven inches, or up to ten inches in accordance with certain exemplary embodiments.

The second portion 18 can be formed on the first sheet 12 in a number of different ways. For example, the second portion 18 can be created by transitioning from a normal three dimensional weave pattern located throughout the majority of the geotextile fabric, that is designed to have an apparent opening size and water flow for dewatering saturated materials such as sludge, to a two dimensional weave pattern located inside of and adjacent to the geotextile fabric's tuck-back. The tuck-back serves as the selvage for previously manufactured woven geotextile fabrics. However, it is to be understood that this method is but one way of creating the second portion 18 with the second weave pattern 20 and that others are possible in accordance with various exemplary embodiments.

The first sheet 12 may contain a pair of second portions 18 on opposite sides of the first portion 14 in the cross direction 40 of the first sheet 12. The combined surface area of the pair of second portions 18 may be less than the surface area of the first portion 14. Alternative arrangements exist in which the surface area of one of the second portions 18 is less than the surface area of the first portion 14, but the combined surface area of the pair of second portions 18 is the same as or greater than the surface area of the first portion 14. The pair of second portions 18 may be the selvage on opposite sides of the first portion 14 in the cross direction 40 of first sheet 12. However, in certain instances of construction of the geotextile tube 10, a width of a particular sheet 12 may need to be smaller than that provided by a manufacturer of woven geotextile fabric sheets. It may be desired to have second portions 18 on opposite sides of the first portion 14 in the cross direction 40. In these arrangements, one of the second portions 18 can be a selvage of the manufactured sheet 12. The other second portion 18 can be a band 94 that has the same weave pattern as the second weave pattern 20 of the second portion 18. The band 94 may be from four inches to eight inches and can be of the same composition as the selvage second portion 18. The band 94 can be inserted at the time of manufacture at any location of the first sheet 12 based upon a desired length in the cross direction 40. Slitting of the first sheet 12 may be accomplished through the use of a hot blade to seal the cut edges.

Figure 3:
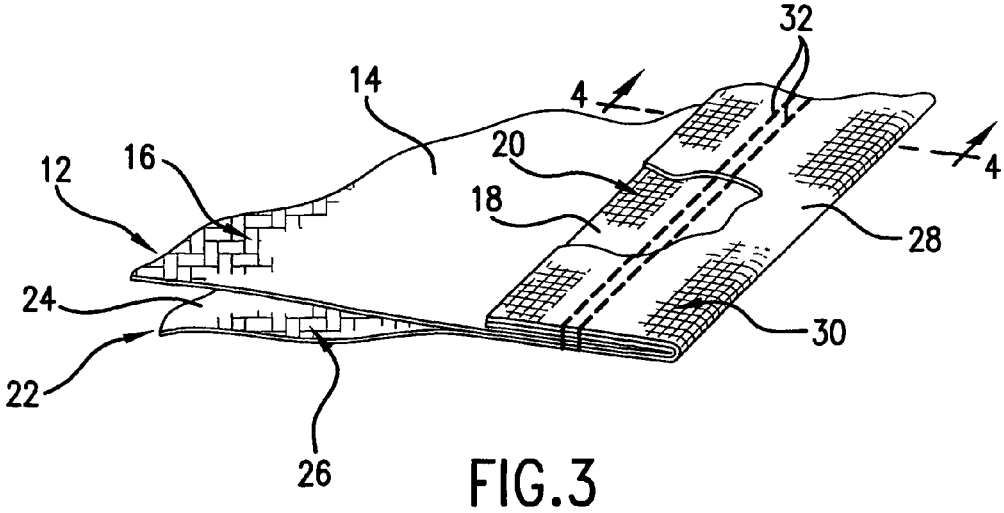
FIG. 3 is a perspective view of a portion of the geotextile tube of FIG. 1 illustrating the longitudinal seam formed upon connection of a first and second sheet.

FIG. 3 shows a portion of the longitudinal seam 32 of the geotextile tube 10 that attaches and connects a first sheet 12 to a second sheet 22. The second sheet 22 may be constructed in a similar manner as the first sheet 12. For example, the second sheet 22 can have a first portion 24 that has a first weave pattern 26, and a second portion 28 that has a second weave pattern 30. The second weave pattern 30 may be constructed so as to be denser and stronger than the first weave pattern 26. Details of arrangement and construction of the second sheet 22 may be the same as that described above with respect to the first sheet 12, and a repeat of this information is not necessary.

The first sheet 12 and second sheet 22 are attached to one another by the seam 32 at the second portions 18 and 28. In this regard, the seam 32 may be entirely located within the second portions 18 and 28 and not located in the first portion 14 or the first portion 24. However, it is to be understood that the geotextile tube 10 can be arranged in other exemplary embodiments in which the seam 32 is located in one or both of the first portions 14 and 24. Placement of the seam 32 within the second portions 18 and 28 effects a stronger connection between the first sheet 12 and the second sheet 22 because the second portions 18 and 28 may be made to be stronger than the first portions 14 and 24 in the direction or directions to which internal or external forces are imparted onto the sheets 12, 22. Incorporation of the seam 32 damages the yarns or weave pattern into which the seam 32 is placed thus causing a weak spot in the overall construction. By locating the seam 32 in stronger portions of the first sheet 12 and 22, the overall strength of the geotextile tube 10 is improved thus resulting in less of a chance of failure in accordance with certain exemplary embodiments.

Figure 4:
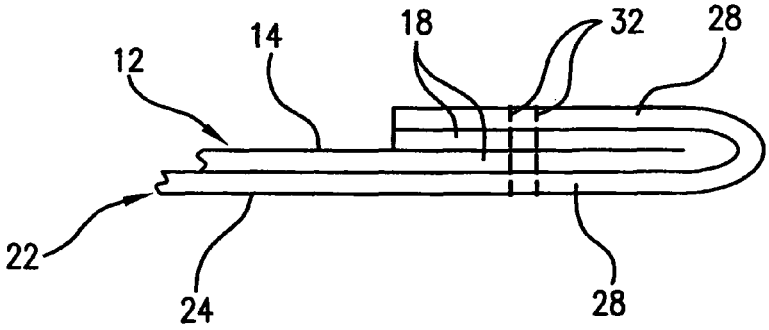
FIG. 4 is a cross-sectional view taken along line 4-4 of FIG. 3.

FIG. 4 is a cross-sectional view taken along line 4-4 in FIG. 3. Further details of the attachment between the first sheet 12 and second sheet 22 are illustrated. The first sheet 12 is located on top of the second sheet 22 so that the first portion 14 is located generally above the first portion 24. The second portions 18 and 28 are folded on top of one another to form an end that is essentially four layers thick. In this regard, the second portion 28 surround the folded over second portion 18 on either side. The seam 32 is located within the second portions 18 and 28 and extends through all four of the arranged layers. The seam 32 is made of two individual stitches, but it is to be understood that any number of stitches may be used to construct the seam 32. Additionally, it is to be understood that the overlapping arrangement of the first sheet 12 and second sheet 22 is only exemplary and that other attachment arrangements of these components are possible in accordance with various exemplary embodiments. The seam type shown in FIG. 4 is sometimes referred to as a "J" seam. However, it is to be understood that other seam types such as a "prayer" seam and/or a "butterfly" seam may be employed in addition to or alternatively to the "J" seam in accordance with other arrangements of the geotextile tube 10.

In accordance with one exemplary embodiment, placement of the seam 32 within the second portions 18 and 28 resulted in an average increase in seam 32 strength from 40% to 80% versus the arrangement in which the seam 32 was not located within the second portions 18 and 28. This increase in strength may be as a result of increased bulk and density of the second weave patterns 20, 30 over the first weave patterns 16, 26. However, it is to be understood that the ultimate strength of the resulting connection will still be influenced by the composition of the geotextile fabric making up the first and second sheets 12 and 22, the thread size of the seam 32, stitching placement of the seam 32, stitches per linear inch of the seam, and craftsmanship in the construction of the finished connection.

The longitudinal seam 32 of the geotextile tube 10 may thus be strengthened by locating the seam 32 in the stronger second portions 18 and 28 of the first and second sheets 12 and 22. In addition, the other seams 92 of the geotextile tube 10 may be constructed in a similar manner if desired. As such, all of the seams 92 of the geotextile tube 10 are formed in the manner previously discussed in accordance with certain exemplary embodiments.

The second portions 18 and 28 may be constructed so that the second weave patterns 20 and 30 permit the yarns arranged in the machine direction 38 to slip a minor amount. In this regard, when the geotextile tube 10 is being filled and is approaching or at its internal pressure limit, the yarns in the second weave patterns 20 and 30 may slip a small degree so as to allow water inside of the geotextile tube 10 to flow therethrough. The yarns of the second weave patterns 20 and 30 may slip without fraying or otherwise being damaged when subjected to pressure forces sufficient to cause water to flow therethrough. Flowing of water through this part of the second portions 18 and 28 adjacent the seam 32 thus alerts an operator present of the fact that the geotextile tube 10 is approaching or at its internal operating pressure. The internal pressure on the geotextile tube 10 can then be reduced in order to prevent any damage or rupture to the various sheets 90 and seams 92. Additionally, the flow of water through the sheets 12 and 22 at the second portions 18 and 28 causes a reduction in internal pressure of the geotextile tube 10 and thus reduces the strain on the sheets 90 and seams 92.

Figure 5:
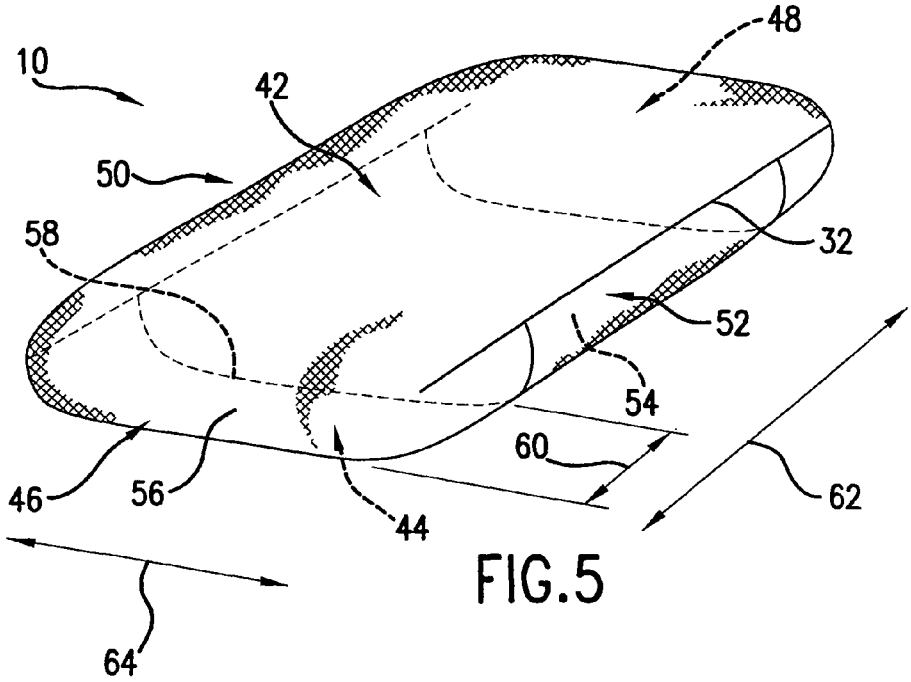
FIG. 5 is a perspective view of a geotextile tube in accordance with another exemplary embodiment in which the first end and second end do not have a transverse seam.

An additional exemplary embodiment of the geotextile tube 10 is shown in FIG. 5. Here, a plurality of sheets 90 connected via seams 92 are arranged so as to form a geotextile tube 10 having a generally ovoid shape. The plurality of sheets 90 are arranged so as to result in a geotextile tube 10 with a top 42, bottom 44, first end 46, second end 48, first side 50 and second side 52. The first end 46 is located opposite the second end 48 in the longitudinal direction 62 of the geotextile tube 10. The first side 50 is located opposite the second side 52 in the transverse direction 64 of the geotextile tube 10. The bottom 44 rests on the ground and is generally trapped between the ground and the contents of the geotextile tube 10 when filled and is thus prevented from moving. The geotextile tube 10 is longer in the longitudinal direction 62 than in the transverse direction 64. Consequently, the first side 50 and second side 52 are longer than the length of the first end 46 and the second end 48.

The geotextile tube 10 includes a number of seams 92 such as a longitudinal seam 32 and a transverse seam 58. The first end 46 and the second end 48 do not include a transverse seam 58 thereon. Removal of transverse seams 58 from the first end 46 and the second end 48 increases the strength of the resulting geotextile tube 10. In this regard, the tensile strength of the woven geotextile fabric sheets 90 may be less in the machine direction 38 than in the cross direction 40 thus resulting in a weak point in the overall design when transverse seams 58 are present on the ends 46 and 48. Removal of the transverse seams 58 from these locations thus eliminates this weak point and in turn results in an increase in the strength of the geotextile tube 10. It is to be understood, however, that other arrangements of the geotextile tube 10 exist in which a transverse seam 58 is located at one, but not both, of the ends 46 and 48. Still other arrangements are possible in which one or more transverse seams 58 are present on both the first end 46 and the second end 48.

The first end 46 may be made completely or at least partially from a sheet 90 such as an end sheet 56. In a similar manner, one of the sheets 90, in this case a bottom sheet 54, forms at least a portion of the bottom 44 of the geotextile tube 10. The end sheet 56 and the bottom sheet 54 are attached and connected to one another by the transverse seam 58. The transverse seam 58 is not located on the first end 46 but is instead located on the bottom 44 of the geotextile tube 10. The transverse seam 58 is thus located a distance 60 from the first end 46. The distance 60 may be at least fifteen feet in accordance with one exemplary embodiment. In accordance with other embodiments, the distance 60 can be from twenty to forty feet, or the distance 60 may be up to fifty feet. In still other embodiments, the distance 60 may be from three to twenty feet.

The contents of the geotextile tube 10 are located above the transverse seam 58 so that the weight of the contents thus press downward upon the transverse seam 58. As previously stated, the transverse seam 58 is supported on one side by the ground so that the forces imparted onto the transverse seam 58 are thus compressive forces from either side. The transverse seam 58 is not subjected to lateral stresses, as would be the case if the transverse seam 58 were located on the first end 46. The transverse seam 58 is thus not subjected to forces sufficient to cause its failure as would be the case, potentially, if the transverse seam 58 were alternatively located on the first end 46. The transverse seam 58 can be made in a variety of manners. For example, the transverse seam 58 can be fashioned so that it is located on second, stronger portions of the bottom sheet 54 and the end sheet 56. This connection can thus be fashioned as that previously stated with respect to the first sheet 12, second sheet 22 and longitudinal seam 32 and a repeat of this information is not necessary. Alternatively, the transverse seam 58 need not be constructed in the enhanced manners as previously described and may instead simply be stitching that is located in larger, weaker portions of the bottom sheet 54 and end sheet 56. Although the first end 46 may lack a transverse seam 58, one or more longitudinal seams 92 may be present in the first end 46 in accordance with certain embodiment. In other arrangements, the first end 46 need not include any longitudinal seams 92 and may be completely seamless.

The second end 48 may also be arranged so that a transverse seam 58 is not present thereon. In this regard, a transverse seam 92 may be located on the bottom 44 and may be used to attach an end sheet 90 to a bottom sheet 90 in a manner similar to that previously described with respect to the transverse seam 58. As such, the second end 48 can be arranged in a manner previously discussed with respect to the first end 46 and a repeat of this information is not necessary.

The geotextile tube 10 can be formed in accordance with one of the designs set forth so that the sheets 90 and seams 92 making up the geotextile tube 10 have a resulting tensile strength of over 70 kN/m in the transverse direction 64 and in the longitudinal direction 62. However, other tensile strengths in the transverse direction 64 and longitudinal direction 62 can be realized upon variation of other properties of the sheets 90 and seams 92.

Figure 6:
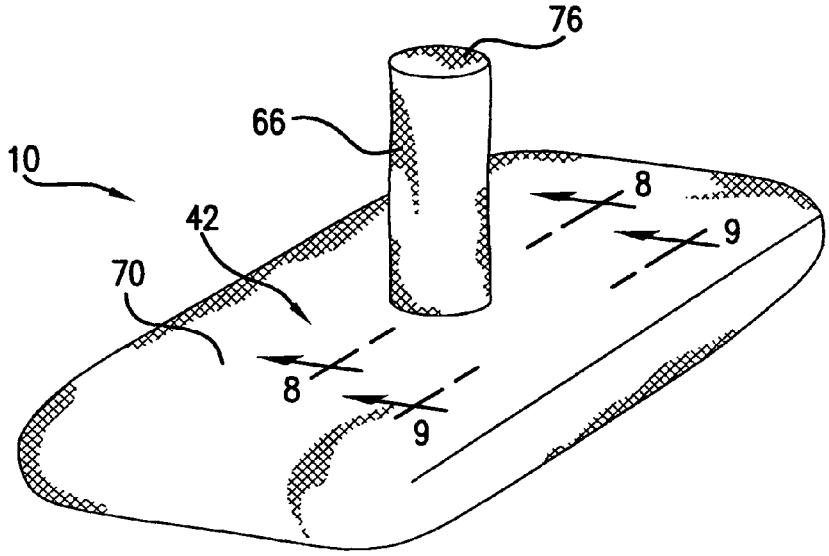
FIG. 6 is a perspective view of a geotextile tube with a fabric port tube in accordance with one exemplary embodiment.

Geotextile tubes 10 often include a fill port on the top thereof in order to provide an opening into which sand, dredging, sludge, slurries or the like can be inserted into the interior of the geotextile tube 10. A filling hose is inserted into the fill port during the filling stage and is often suspended by a crane, excavator, or other apparatus. Quite often this equipment is inadvertently repositioned subjecting the fill port to undue stress. Forces may be imparted to the geotextile tube 10 at the location of the fill port thus causing it to tear or fail at this location. FIG. 6 is a perspective view of the geotextile tube 10 in accordance with one exemplary embodiment. Here, a fabric port tube 66 is present on the top 42 of the geotextile tube 10 to facilitate the insertion of materials therein. The fabric port tube 66 may be made of the same woven geotextile fabric present in the sheets 90 that make up the geotextile tube 10. In other embodiments, the fabric port tube 66 can be made of a different material than the sheets 90. The fabric port tube 66 is constructed so as to have a generally cylindrical shape that is open on opposite ends. The fabric port tube 66 in this arrangement has a circular shaped opening 76. However, it is to be understood that the fabric port tube 66 can be variously shaped in other embodiments. The fabric port tube 66 can have a diameter from six inches to eighteen inches. Further, the length of the fabric port tube 66 may be four feet.

Figure 7:
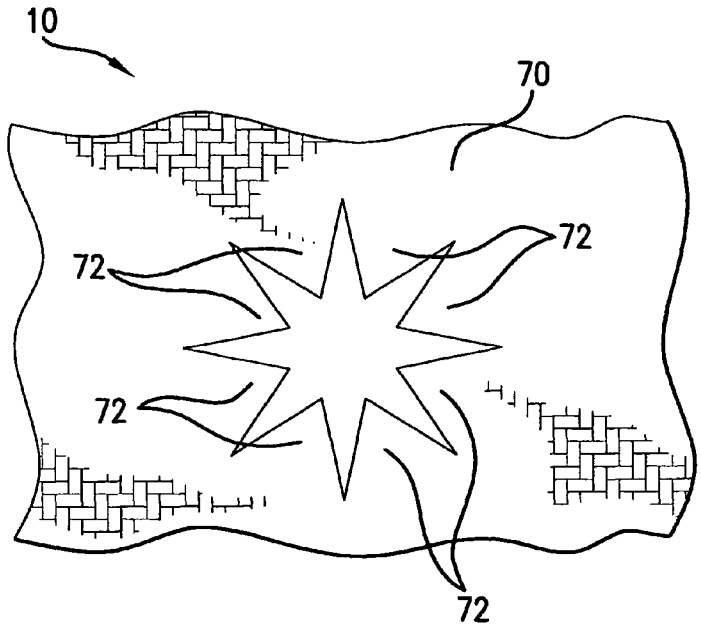
FIG. 7 is a plan view of a portion of a top sheet of the geotextile tube in accordance with one exemplary embodiment.

FIG. 7 shows a plan view of a portion of the top 42 of the geotextile tube 10 before attachment of the fabric port tube 66. Here, an aperture is cut or is initially formed in a sheet 90, that is a top sheet 70, that forms at least a portion of the top 42 such that a plurality of flaps 72 are present generally about the circumference of an aperture. The flaps 72 can be integrally formed with the top sheet 70 or may be separate components that are attached thereon. The flaps 72 can be made of the same woven geotextile fabric that makes up the top sheet 70. The flaps 72 are shown forming a star-like shape in the top sheet 70. Although shown as having a plurality of flaps 72 disposed about the entire circumference of an aperture, it is to be understood that other arrangements exist in which only one or two flaps 72 are present, and other embodiments are possible in which the flaps 72 do not extend completely around the entire aperture.

Figure 8:
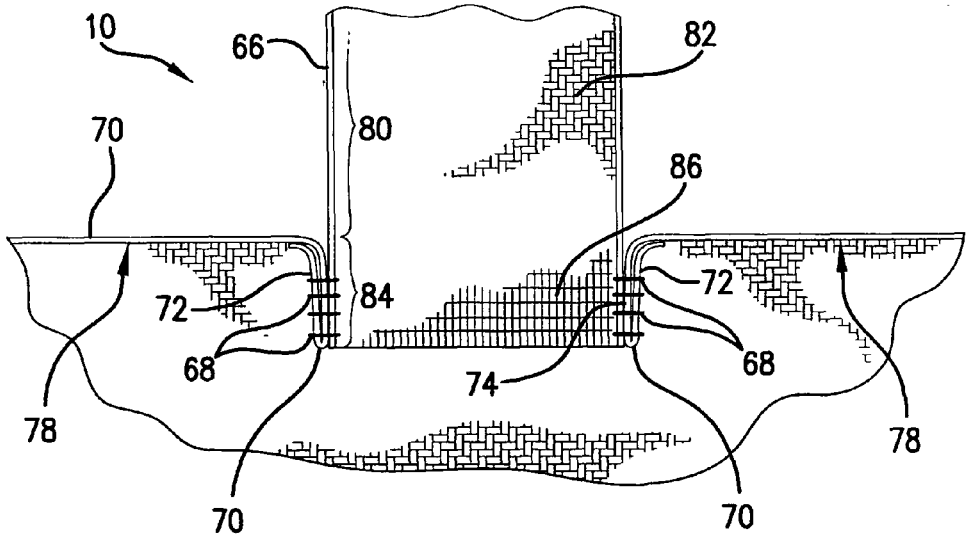
FIG. 8 is a cross-sectional view taken along line 8-8 of FIG. 6.
Figure 9:
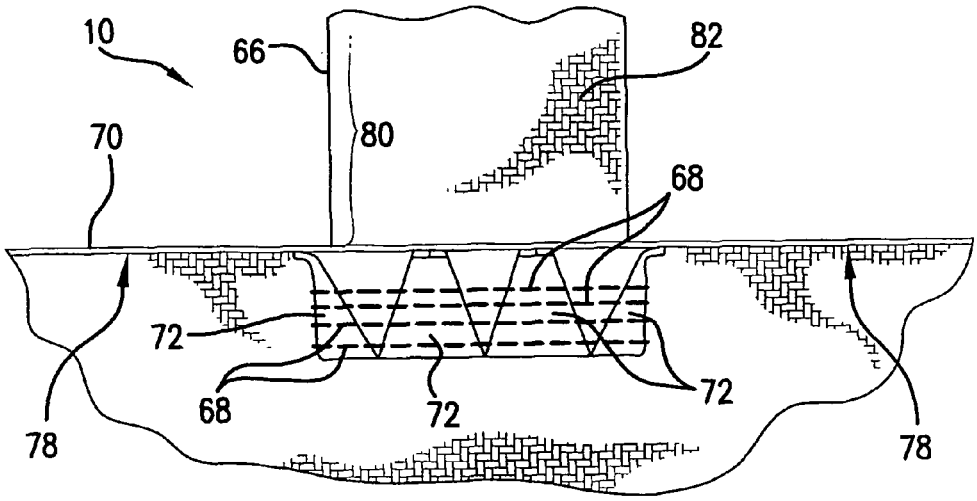
FIG. 9 is a cross-sectional view taken along line 9-9 of FIG. 6.

FIGS. 8 and 9 are cross-sectional views taken about lines 8-8 and 9-9 of FIG. 6. The flaps 72 are folded from their positions shown in FIG. 7 when the fabric port tube 66 is attached. The flaps 72 are folded down into the interior of the geotextile tube 10 so that the flaps 72 lay adjacent the inner surface 78 of the top sheet 70. The fabric port tube 66 is positioned into the aperture formed in the top sheet 70, which is now circular due to the folding back of the flaps 72. A fill port seam 68 can be incorporated in order to attach the fabric port tube 66 to the top sheet 70. The fill port seam 68 may contact the fabric port tube 66, the flaps 72, and a portion 74 of the top sheet 70 positioned between the fabric port tube 66 and the flaps 72 due to the folding back of the flaps 72. The fill port seam 68 can be any number of stitches in accordance with various exemplary embodiments. In accordance with one exemplary embodiment, the fill port seam 68 is made of five stitches that pass through and contact the three previously mentioned components. The presence of the flaps 72 thus results in a thicker, and therefore stronger, attachment area for the fabric port tube 66 so that the resulting fill port seam 68 is stronger and less likely to fail.

The fabric port tube 66 can be constructed so that it includes a first portion 80 with a first weave pattern 82. A second portion 84 can also be included in the fabric port tube 66 and may have a second weave pattern 86. The second weave pattern 86 can be denser and stronger than the first weave pattern 82. In accordance with one exemplary embodiment, the second portion 84 is the selvage of the woven geotextile fabric sheet making up the fabric port tube 66. The second portion 84 of the fabric port tube 66 is thus the area of the fabric port tube 66 through which the fill port seam 68 is disposed; This configuration also affords a stronger resulting connection because the seam area is thus made thicker and stronger by location of the fill port seam 68 into the stronger second portion 84. As such, the fill port seam 68 may be located only in the second portion 84 of the fabric port tube 66 and not in the first portion 80. However, it is to be understood that other embodiments are possible in which the fill port seam 68 is located in both the first portion 80 and the second portion 84. The portion 74 and/or the flaps 72 can also be portions of the top sheet 70 that are stronger than other portions of the top sheet 70. For example, the portion 74 and/or the flaps 72 may be the selvage in accordance with certain exemplary embodiments. This arrangement may be as described above with respect to other embodiments and a repeat of this information is not necessary. Additionally, it is to be understood that in other arrangements the portion 74 and/or the flaps 72 need not be strengthened portions of the top sheet 70.

Figure 10:
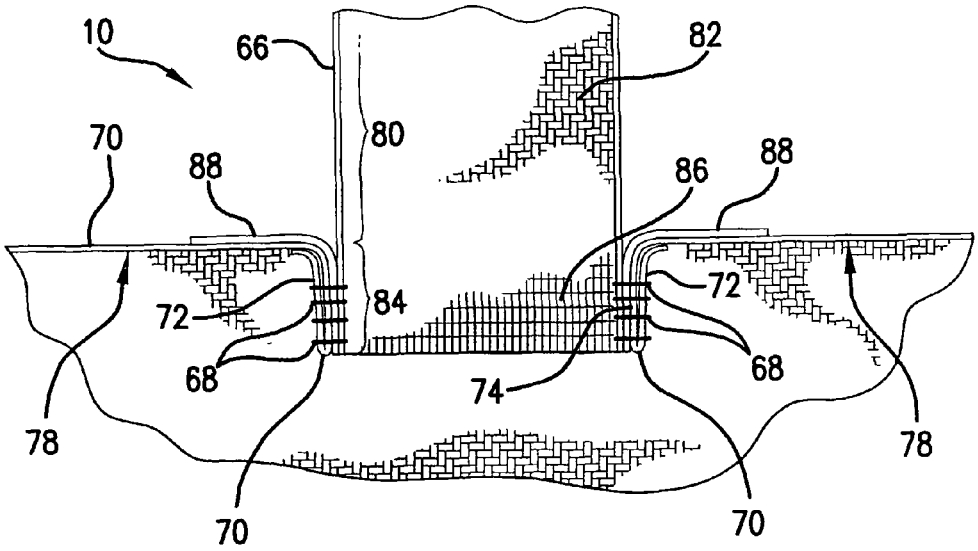
FIG. 10 is a cross-sectional view of a geotextile tube in accordance with one exemplary embodiment.

FIG. 10 shows an alternative exemplary embodiment of the connection of the fabric port tube 66. Here, a fabric backing 88 may be included and attached to the top sheet 70. The fabric backing 88 may be a polymeric material and can be located on the top of the top sheet 70 in one embodiment. The fill port seam 68 can be disposed through the flaps 72, the portion 74 of the top sheet 70, the second portion 84 of the fabric port tube 66, and the fabric backing 88. The presence of the fabric backing 88 acts to create a thicker, and hence stronger, attachment area for the fabric port tube 66.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A geotextile tube, comprising:

a first sheet having a first portion with a first weave pattern and a second portion with a second weave pattern, wherein said first portion of said first sheet covers a larger surface area of said first sheet than said second portion of said first sheet;

a second sheet having a first portion with a first weave pattern and a second portion with a second weave pattern, wherein said first portion of said second sheet covers a larger surface area of said second sheet than said second portion of said second sheet; and a seam contacting and attaching said second portion of said first sheet to said second portion of said second sheet, wherein said second portion of said first sheet contacts said second portion of said second sheet and wherein said seam is made of stitches that contact both of said second portions.

2. The geotextile tube as set forth in claim 1, wherein said seam does not contact said first portion of said first sheet, and wherein said seam does not contact said first portion of said second sheet.

3. The geotextile tube as set forth in claim 1, wherein said second weave pattern of said second portion of said first sheet is denser than said first weave pattern of said first portion of said first sheet, and wherein said second weave pattern of said second portion of said second sheet is denser than said first weave pattern of said first portion of said second sheet, and wherein said second portions of both of said first sheet and said second sheet are at least two inches in width, and wherein said first sheet and said second sheet are made of woven geotextile fabric.

4. The geotextile tube as set forth in claim 1, wherein said seam is a longitudinal seam.

5. The geotextile tube as set forth in claim 1, wherein said second portion of said first sheet is a selvage of said first sheet, and wherein said second portion of said second sheet is a selvage of said second sheet.

6. The geotextile tube as set forth in claim 1, wherein said second weave pattern of said second portion of said first sheet is configured to allow slippage of machine direction yarn in the cross-machine direction upon being subjected to pressure forces to allow water to flow through said second portion so as to reduce pressure within said geotextile tube.

7. The geotextile tube as set forth in claim 1, further comprising:

a bottom sheet that forms at least a portion of the bottom of said geotextile tube;

an end sheet that forms at least a portion of an end of said geotextile tube; and a transverse seam contacting and attaching said bottom sheet to said end sheet, wherein said transverse seam is located at least fifteen feet from said end of said geotextile tube, and wherein said transverse seam is located on the bottom of said geotextile tube.

8. A geotextile tube, comprising:

a plurality of sheets attached to one another so as to form a top, bottom, first end, second end, first side, and second side of said geotextile tube, wherein said first end and said second end are opposite one another in the longitudinal direction, and wherein said first side and said second side are opposite one another in the transverse direction;

a transverse seam contacting and attaching one of said sheets that forms at least a portion of said bottom of said geotextile tube to one of said sheets that forms at least a portion of said first end of said geotextile tube, wherein said transverse seam is located on the bottom of said geotextile tube;

wherein said plurality of sheets include a first sheet and a second sheet;

wherein said first sheet has a first portion with a first weave pattern and a second portion with a second weave pattern, wherein said first portion of said first sheet covers a larger surface area of said first sheet than said second portion of said first sheet;

wherein said second sheet has a first portion with a first weave pattern and a second portion with a second weave pattern, wherein said first portion of said second sheet covers a larger surface area of said second sheet than said second portion of said second sheet; and a seam contacting and attaching said second portion of said first sheet to said second portion of said second sheet, wherein said seam extends in the longitudinal direction.

9. The geotextile tube as set forth in claim 8, wherein said first end does not have a seam that extends in the transverse direction located thereon.

10. The geotextile tube as set forth in claim 9, wherein said second end does not have a seam that extends in the transverse direction located thereon.

11. The geotextile tube as set forth in claim 8, wherein said transverse seam is located at least fifteen feet from said first end.

12. The geotextile tube as set forth in claim 8, wherein said sheets are two in number, and wherein said sheets are made of woven geotextile fabric.

13. The geotextile tube as set forth in claim 8, further comprising:

a fabric port tube attached to one of said sheets that forms at least a portion of said top of said geotextile tube; and a fill port seam that is attached to and contacts said fabric port tube and a plurality of flaps of said one of said sheets that forms at least a portion of said top of said geotextile tube.

14. A geotextile tube, comprising:

a plurality of sheets attached to one another so as to form a top, bottom, first end, second end, first side, and second side of said geotextile tube, wherein said first end and said second end are opposite one another in the longitudinal direction, and wherein said first side and said second side are opposite one another in the transverse direction, wherein said plurality of sheets define an interior of said geotextile tube;

a fabric port tube attached to at least one of said sheets that forms at least a portion of said top of said geotextile tube; and a fill port seam that is attached to and contacts said fabric port tube and a plurality of flaps of said at least one of said sheets that forms at least a portion of said top of said geotextile tube, wherein said plurality of flaps are located in said interior of said geotextile tube and below an upper surface of said top of said geotextile tube when said fabric tube port is positioned for receipt of material therethrough and into said interior of said geotextile tube.

15. The geotextile tube as set forth in claim 14, wherein a portion of said one of said sheets that forms at least a portion of said top of said geotextile tube is disposed between said plurality of flaps and said fabric port tube such that said plurality of flaps and said fabric port tube do not contact one another.

16. The geotextile tube as set forth in claim 14, wherein said fabric port tube defines a circular shaped opening, and wherein said plurality of flaps are triangular in shape and are located about the entire perimeter of said circular shaped opening of said fabric port tube, wherein said plurality of flaps contact the inner surface of said one of said sheets that forms at least a portion of said top of said geotextile tube.

17. The geotextile tube as set forth in claim 14, wherein said fabric port tube is a sheet of woven geotextile fabric, wherein said fabric port tube has a first portion with a first weave pattern and a second portion with a second weave pattern, wherein said first portion of said fabric port tube covers a larger surface area of said geotextile tube than said second portion of said geotextile tube, wherein said second weave pattern of said second portion is denser and stronger than said first weave pattern of said first portion, and wherein said fill port seam contacts said second portion of said fabric port tube and does not contact said first portion of said fabric port tube.

18. The geotextile tube as set forth in claim 14, further comprising a fabric backing, wherein said fill port seam is attached to and contacts said fabric backing.

19. The geotextile tube as set forth in claim 14, further comprising a transverse seam contacting and attaching one of said sheets that forms at least a portion of said bottom of said geotextile tube to one of said sheets that forms at least a portion of said first end of said geotextile tube, wherein said transverse seam is located on the bottom of said geotextile tube, wherein said first end and said second end do not have any transverse seams located thereon.

* * * * *